US009085400B2

(12) United States Patent
Van Cuijk

(10) Patent No.: US 9,085,400 B2
(45) Date of Patent: Jul. 21, 2015

(54) METHOD FOR CLOSING OF A CONTAINER AND A THUS MANUFACTURED PACKAGING

(75) Inventor: Wilhelmus Henricus Maria Van Cuijk, Uden (NL)

(73) Assignee: Abarka Packaging Solutions B.V., Uden (NL)

( * ) Notice: Subject to any disclaimer, the term of this patent is extended or adjusted under 35 U.S.C. 154(b) by 353 days.

(21) Appl. No.: 13/001,952

(22) PCT Filed: Jun. 29, 2009

(86) PCT No.: PCT/NL2009/050380
§ 371 (c)(1),
(2), (4) Date: Dec. 29, 2010

(87) PCT Pub. No.: WO2010/002247
PCT Pub. Date: Jan. 7, 2010

(65) Prior Publication Data

US 2011/0117250 A1 May 19, 2011

(30) Foreign Application Priority Data

Jul. 1, 2008 (NL) ..... 2001739

(51) Int. Cl.
*B65D 41/00* (2006.01)
*B65D 77/20* (2006.01)
*B65D 41/14* (2006.01)

(52) U.S. Cl.
CPC ..... *B65D 77/2024* (2013.01); *B65D 41/14* (2013.01)

(58) Field of Classification Search
CPC ..... B65D 77/20; B65D 41/14
USPC ..... 215/251; 53/410, 411, 329.2, 129.1; 220/359.1, 359.4, 256.1, 267.1; 156/183, 474, 475
See application file for complete search history.

(56) References Cited

U.S. PATENT DOCUMENTS

| | | | | | |
|---|---|---|---|---|---|
| 2,144,592 | A | * | 1/1939 | Gehman | 53/478 |
| 2,634,012 | A | * | 4/1953 | Copeman | 215/327 |
| 3,220,907 | A | * | 11/1965 | Hundt et al. | 156/245 |
| 4,184,310 | A | * | 1/1980 | Shelby | 53/412 |
| 4,658,568 | A | * | 4/1987 | Reid et al. | 53/410 |

(Continued)

FOREIGN PATENT DOCUMENTS

| | | | |
|---|---|---|---|
| DE | 202005016588 | U1 | 8/2006 |
| EP | 1193179 | A1 | 4/2002 |
| WO | 9107325 | A1 | 5/1991 |

OTHER PUBLICATIONS

Anoniem, Landliebe Naturjoghurt Orginal 200 g, Internet artikel [Online], Retrieved from the Internet: URL: http://das-ist-drin.de/Landliebe-Naturjoghurt-Orginal-200-g--7237, Jun. 6, 2008, XP002510677, [retrieved on Jan. 16, 2009], the whole document.

(Continued)

*Primary Examiner* — Anthony Stashick
*Assistant Examiner* — James Way
(74) *Attorney, Agent, or Firm* — The Webb Law Firm

(57) ABSTRACT

A method for closing an opening in a container for food products, such as a tray or jar, has the processing steps of: A) arranging a flexible foil layer over the opening which protrudes outside the edge of the opening; B) urging the protruding part of the foil layer against the outer side of the container; and C) attaching the foil layer to the container. A packaging may also be manufactured using this method.

17 Claims, 4 Drawing Sheets

(56) References Cited

U.S. PATENT DOCUMENTS

| | | | | |
|---|---|---|---|---|
| 6,196,404 | B1 * | 3/2001 | Chen | 220/4.21 |
| 6,291,037 | B1 * | 9/2001 | Bakker et al. | 428/34.7 |
| 6,460,716 | B1 * | 10/2002 | Wong | 220/4.24 |
| 6,708,748 | B1 | 3/2004 | Kronseder et al. | |
| 2006/0231563 | A1 | 10/2006 | Olivar | |

OTHER PUBLICATIONS

Anoniem, Purnatur Yogh Natuur 150G, Internet artikel [Online], Retrieved from the Internet: URL: http://www.purnatur.eu/PRO/PDF/PurNatur/665_NL.pdf, Mar. 17, 2008, XP002510696, [retrieved on Jan. 16, 2009], the whole document.

* cited by examiner

METHOD FOR CLOSING OF A CONTAINER AND A THUS MANUFACTURED PACKAGING

BACKGROUND OF THE INVENTION

1) Field of the Invention

The present invention relates to a method for covering an opening of a container, such as for instance a tray, tub, bucket, cup, dish or jar. The invention also relates to a packaging, comprising: a container provided with at least one opening; and a flexible foil layer arranged over the opening, wherein the overhanging part of the foil layer is pleated substantially along the outer side of the container.

2) Description of the Prior Art

Packagings can consist of a more or less form-retaining container with an opening. Such containers are usually covered in practice with a lid and/or by a layer of foil material. For decorative purposes a cover of a foil material, such as for instance paper or textile, is sometimes also arranged over the opening, this cover not only covering the opening but also hanging downward along the periphery of the container (or the contour of the container). Such a decorative overhanging edge is also referred to as a "skirt". The skirt gives a "traditional" appearance to products such as for instance jars filled with pâtés and jam. The skirt can be clamped by the lid or—when attached to the outside of a lid—be clamped round the lid and/or an edge of the container using for instance a string, ribbon or elastic band. Arranging a skirt in this way is however labour-intensive.

The present invention has for its object to provide an overhanging foil layer and a method for arranging such a foil layer, such that the cover has a greater functionality, is relatively inexpensive and simple to arrange.

SUMMARY OF THE INVENTION

The present invention provides for this purpose a method for closing an opening in a container for food products, such as a tray, tub or jar, comprising the processing steps of: A) arranging a flexible foil layer over the opening such that the foil layer protrudes outside the edge of the opening of the container; and B) urging the part of the foil layer protruding outside the edge of the opening against the outer side of the container; and C) attaching the foil layer to the outer side of the container such that the opening is covered by the foil layer and the part of the foil layer overhanging the opening is pleated along the outer side of the container.

Owing to this method it is no longer necessary to fix the overhanging foil layer to the container by means of a separate closing element such as for instance a string, a ribbon or an elastic band. Arranging the foil layer is hereby simpler and can also be mechanized. Another important advantage is that the connection of the foil layer to the container improves and made more secure. The container is thus better and/or more reliably closed, this being particularly desirable for use in food products.

The foil layer is preferably tensioned over the opening. This makes possible a greater loading of the foil material tensioned over the opening, for instance for the purpose of stacking a plurality of containers. The foil layer can thus also contribute toward the strength and form-retention of the packaging, which also provides the possibility of embodying the container with thinner walls than heretofore.

The foil layer can advantageously be pleated round an upright edge of the container, which can also simplify the attachment of the foil material to the container.

The foil layer is preferably connected medium-tightly to the container. This is advantageous in respect of preventing deterioration of the food products and can make additional sealing of the container unnecessary. It also reduces the chance of leakage from the container. It is noted that the foil layer can be attached releasably to the container in order to provide access to the content of the container, and that it is also possible to envisage that the released foil layer can be re-attached and is thus reclosable. Alternatively, the foil layer can conversely be arranged such that the container can only be opened once, by cutting open and thus damaging the foil. It is hereby apparent to a user of an unopened container or foil layer that the food product in the container is fresh and intact.

The attachment can take place in that the foil layer is adhered ("sealed") to the container by means of heating. In this way closure can take place in simple manner and the presence of adhesive is unnecessary, this being particularly desirable in the vicinity of foods. A medium-tight connection for instance can thus be obtained. The material of the foil layer and the container must of course be suitable for this purpose. Envisage here for instance a layered foil material with a melting layer. It is however also possible to glue or stick the foil layer to the container. The choice of a determined method of attachment depends partly on the materials chosen for the container and the flexible foil layer. In the case of a plastic container and a plastic foil layer heating is a suitable solution, in the case of a glass container and a paper foil layer adhesion with an adhesive material is a more obvious choice. In general the containers can for instance consist of plastic, glass, (coated) paper or material pressed from paper pulp, or of aluminium, and the foil can consist of plastic, (coated) paper or material pressed from paper pulp, or of aluminium.

For a good connection of the foil layer to the container it is desirable that the foil layer is attached in flat manner to the edge of the opening. Particularly when the edge is upright, the edge is also readily accessible. The foil layer can however also be attached to the container with the part of the foil layer pleated around the outer side of the container. An advantage here is that the overhanging part of the foil layer can then also be placed/held in the desired direction, although because the foil layer will be pleated at this position it is not easy to achieve a good (medium-tight) connection of this overhanging part of the foil material. It is for instance possible to envisage not attaching the overhanging part of the foil material to the container over the whole periphery of the opening but only doing so at determined positions. If a good closure of the container is aimed for and it is also desired to place the overhanging part of the foil material in a secure position, it is of course also possible to opt for attaching the foil material in flatter manner to the edge as well as attaching the overhanging part to the outer side of the container. A dual attachment is thus obtained, which of course also results in an even more secure closure.

When the part of the foil layer protruding outside the edge of the opening is urged against the outer side of the container, wave-shaped or zigzag-shaped pleats can be arranged in the overhanging part of the foil layer. In this way the local excess of the foil material is distributed in controlled manner over the periphery, which can also be aesthetically advantageous.

In addition to being closed with the flexible foil layer, the opening can further be closed with an additional closure, such as a clamping or screw lid. The lid can be reclosable. It is possible to first close the opening in the container with a lid and to then place the foil layer thereover. Alternatively, it is however also possible to first close the opening with the foil layer and then arrange the lid over the foil layer.

The invention also relates to a packaging of the type stated in the preamble, wherein the foil layer is attached releasably to the outer side of the container. The foil layer can here be tensioned over the opening and the foil layer can engage around a protruding edge around the opening of the container. The foil layer can be attached medium-tightly to the container and the foil layer can, as desired, be melted onto or glued to the container. It is further possible to attach the foil layer in flat manner to the edge of the opening and/or attach the pleated part of the foil layer to the outer side of the container. The closure with the foil layer can optionally be combined with a lid. For a discussion of the advantages of this packaging reference is made to the advantages as already discussed above in respect of the method according to the present invention.

The foil layer can be provided with a structure such as a paper or a textile structure. In yet another advantageous embodiment the foil layer is provided with a printing, and this printing can be decorative but can also comprise text. Depending on the type of container, the protruding part of the foil layer pleated along the outer side of the container will enclose an angle with the foil material closing the opening of between 45 and 135 degrees, preferable an angle of 80 -100 degrees, illustrated, for example, by angle A in FIG. 8.

BRIEF DESCRIPTION OF THE DRAWINGS

The invention will be further elucidated on the basis of the non-limitative exemplary embodiments shown in the following figures. Herein.

DETAILED DESCRIPTION OF THE PREFERRED EMBODIMENTS

Figure 1:
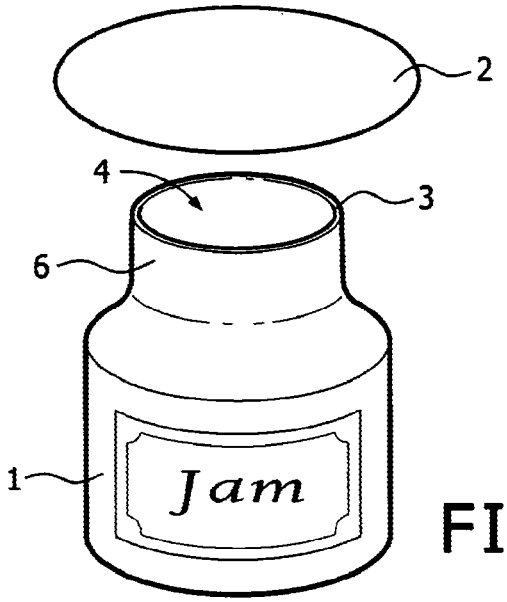
FIG. 1 shows a perspective view of a container and a foil layer according to the present invention before it is attached.

FIG. 1 shows a container 1 for a food product. Container 1 is a jar, more particularly a jam jar. The figure also shows a flexible foil layer 2 which is optionally provided with a structure, such as a paper, cardboard, textile or jute structure. Foil layer 2 serves to cover an opening 4 in container 1 encircled by an edge 3, which in this case connects to an upright wall part 6 of jar 1. Foil layer 2 is larger than opening 4.

Figure 2:
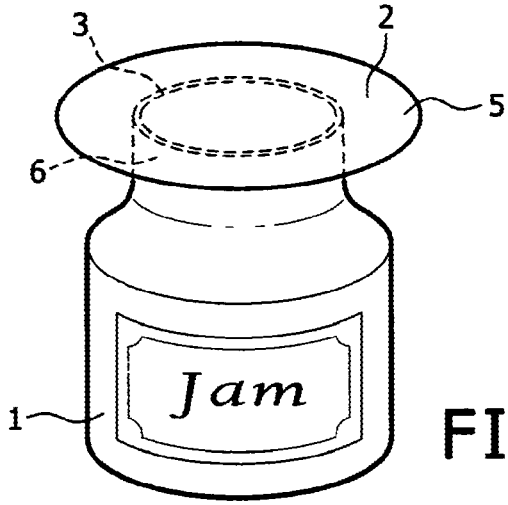
FIG. 2 shows a perspective view of the container of FIG. 1, wherein the foil layer is laid against an opening of the container.

FIG. 2 shows container 1 and foil layer 2 of FIG. 1. Foil layer 2 is placed on edge 3 of opening 4 of the container and thus wholly covers opening 4. The foil layer can be attached to edge 3 of the container. Depending particularly on the foil material, it is possible to opt for glueing or for melting (welding/sealing). Through fixing of foil material 2 the opening 4 can here be closed medium-tightly (hermetically). After attachment, a part 5 of foil layer 2 protrudes outside edge 3 of opening 4.

Figure 3:
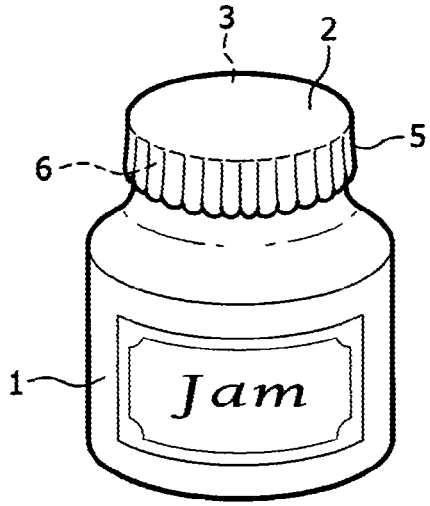
FIG. 3 shows a perspective view of the container of FIG. 2, wherein the foil layer is pleated along the outer side of the container.

FIG. 3 shows container 1 and foil layer 2 of FIG. 2. Foil layer 2 is fixed to edge 3 of container 1 and overhanging part 5 of foil layer 2, which in FIG. 2 protruded beyond edge 3, is now pleated along the outer side of container 1, in particular along upright wall part 6 of container 1. A skirt is thus created, which not only brings about closure of container 1 but also results in a specific appearance.

Figure 4:
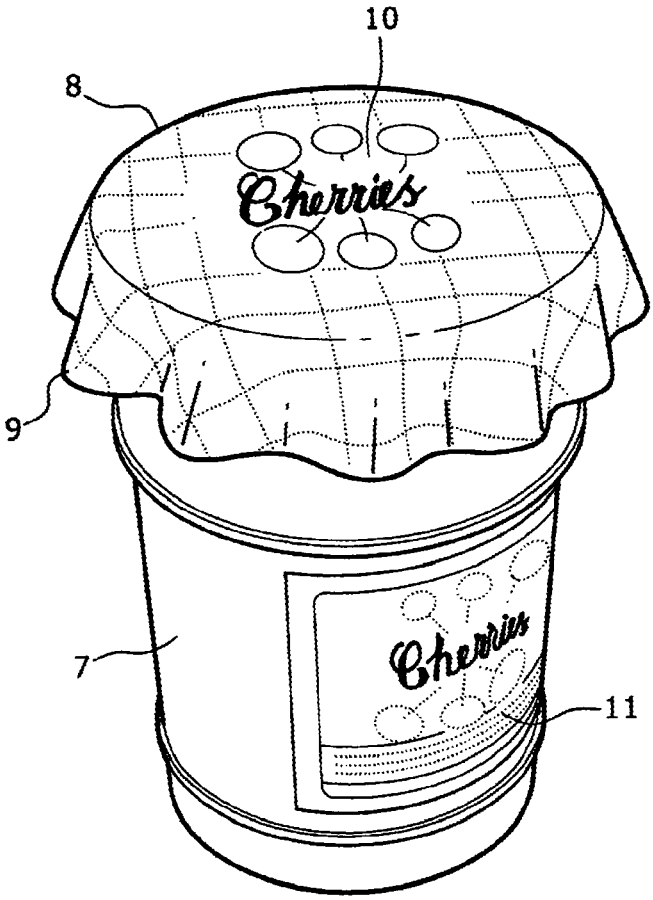
FIG. 4 shows a perspective view of a packaging according to the present invention.

FIG. 4 shows a perspective view of a container 7 according to the present invention. Container 7 is provided with a foil layer 8, which has a pleated, overhanging foil part 9 along the outer side of container 1. Foil layer 8 is provided with a printing 10 with product information about the food product in container 7. This information serves as addition to the information on a label 11 arranged on the outer side of container 7.

Figure 5:
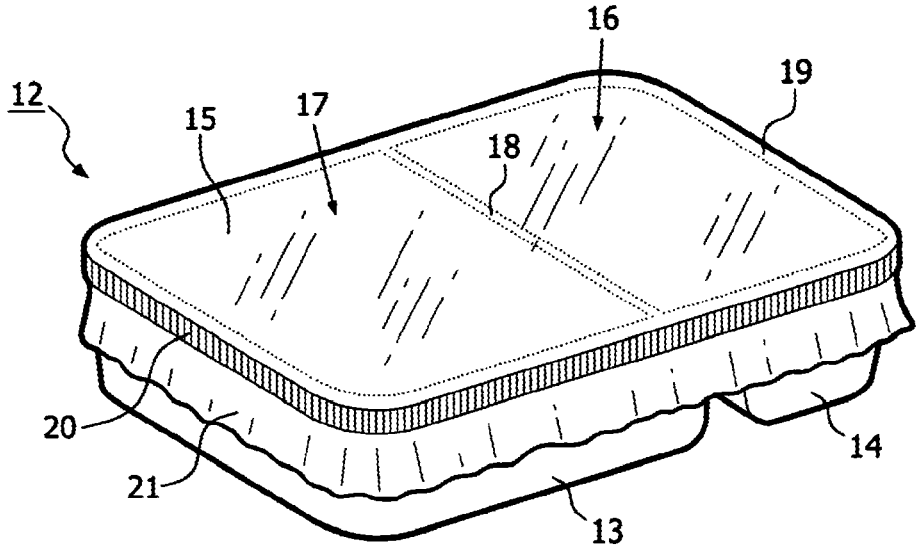
FIG. 5 shows a perspective view of an alternative embodiment of a packaging according to the present invention.

FIG. 5 shows an alternative embodiment of a container 12 according to the present invention. Container 12 comprises a first compartment 13 and a second compartment 14. Container 12 comprises two openings 16 and 17 which are enclosed by a shared edge 19 and separated by partition 18. Foil layer 15 extends over both openings 16 and 17 and is attached to edge 19 and partition 18. The two compartments 16, 17 can in this way be opened individually, for instance by removing foil layer 15 precisely as far as partition 18. This container 12 is highly suitable for use as packaging for (microwave) meals, meat or fish, snacks or dishes. Foil layer 15 is fixed to the outer side 20 of container 12 in order to thus pleat an overhanging foil part 21 as a skirt round container 12.

Figure 6:
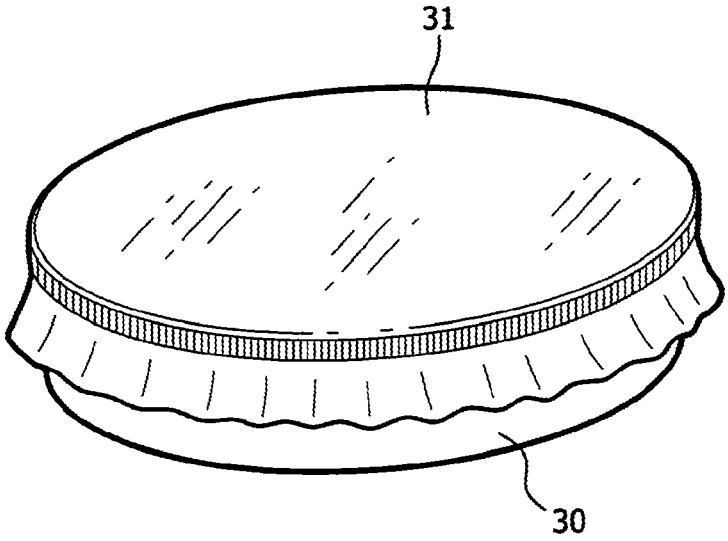
FIG. 6 shows a perspective view of yet another embodiment of a packaging according to the present invention.

FIG. 6 shows a further embodiment of a dish-like container 30 provided with a foil layer 31. This embodiment is particularly suitable for salads, snacks, cheese (spread) and confectionery.

Figure 7:
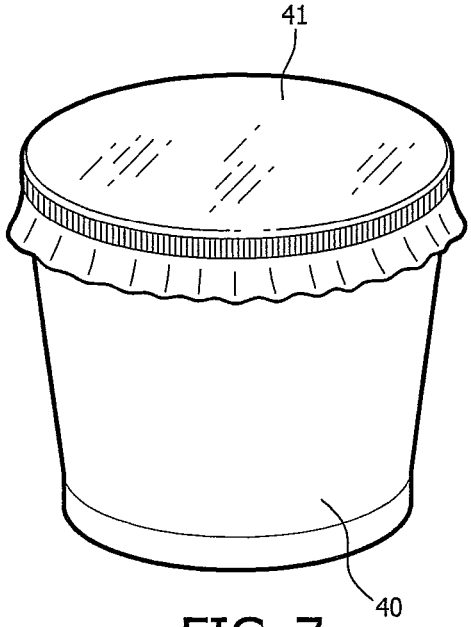
FIG. 7 shows a perspective view of yet another embodiment of a packaging according to the present invention.

FIG. 7 shows a container 40 with a foil layer 41 in an embodiment which is particularly suitable for jam, pâté or tartare, tapenades, dairy or desserts, nuts, PET packagings for dog and cat food, soups and sauces.

Figure 8:
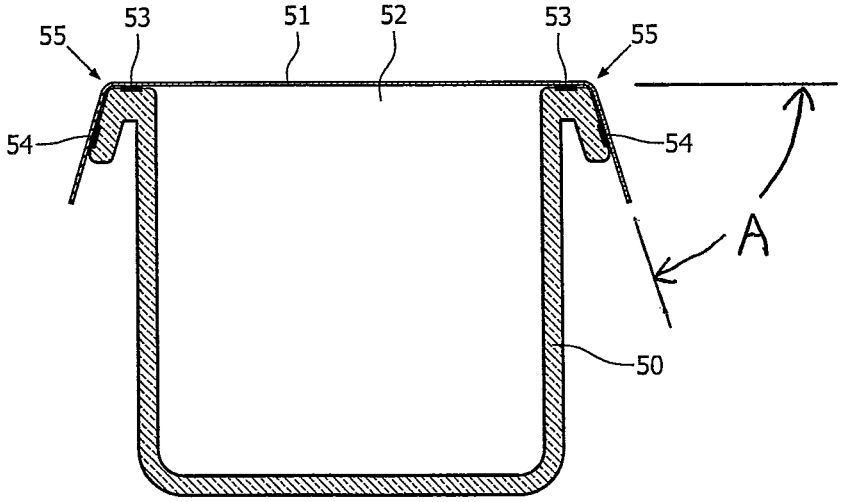
FIG. 8 shows a cross-section of a container with foil attached thereto.

FIG. 8 shows a cross-section of a container 50 to which a foil layer 51 is attached. The foil layer covers opening 52, has a first attachment 53 to an edge of the container, which edge encircles opening 52. Arrows 55 indicate where foil 51 is pleated round container 50. The foil also has a second attachment 54 to an outer side of the container. First attachment 53 serves to seal the foil onto the container, second attachment 54 serves to hold the foil in a pleated form.

In addition to the shown embodiments and applications, various other embodiments are possible which can be provided with a printed or transparent foil and which can be applied as portion packages, for instance for butter, jam, sauce such as mayonnaise or dressing, or cheese, or for consumer packagings for salad, butter, jam, meals or desserts. In addition, bulk packagings for salads, dairy, dog food or confectionery can be manufactured according to the present invention. Boxes or cans can also be applied in addition to the shown containers. The container can further be applied for packaging soap and suchlike personal care products, or jewellery or other gifts.

The invention claimed is:

1. A method for closing an opening in a container for food products comprising the processing steps of:

A) arranging a flexible plastic foil layer over the opening such that the foil layer protrudes outside a wall of the container in which the opening is situated;

B) urging the part of the foil layer protruding outside the edge of the opening against the outer side of the container; and C) adhering the foil layer directly to the outer side of the container at the edge such that the opening is covered by the foil layer and the part of the foil layer overhanging the opening is pleated along the outer side of the container, wherein the foil layer is attached to the container with the part of the foil layer pleated around the outer side of the container wherein the foil layer is melted by heating and thereby attached to the container.

2. The method as claimed in claim 1, wherein the foil layer is tensioned over the opening.

3. The method as claimed in claim 1, wherein the foil layer is pleated around the edge around the opening of the container.

4. The method as claimed in claim 1, wherein the foil layer s attached in a flat manner to the edge of the opening.

5. The method as claimed in claim 1, wherein when the part of the foil layer protruding outside the edge of the opening is urged against the outer side of the container, wave-shaped or zigzag-shaped pleats are arranged in the overhanging part of the foil layer.

6. The method as claimed in claim 1, comprising of attaching the foil layer to the outer side of the container such that it is releasable.

7. The method as claimed in claim 1, wherein a lid is also placed on the opening.

8. A packaging, comprising:

a container provided with at least one opening;

a flexible plastic foil layer arranged over the opening, wherein the protruding part of the foil layer is pleated substantially along the outer side of the container, wherein the foil layer is adhered directly and releasably to the outer side of the container, wherein the foil layer is attached in flat manner to the edge of the opening and that the pleated part of the foil layer is attached to the outer side of the container, and wherein the foil layer is melted by heating and thereby attached to the container.

9. The packaging as claimed in claim 8, wherein the foil layer is tensioned over the opening.

10. The packaging as claimed in claim 8, wherein the foil layer engages around a protruding edge around the opening of the container.

11. The packaging as claimed in claim 8, wherein the foil layer is attached in a flat manner to the edge of the opening.

12. The packaging as claimed in claim 8, wherein the opening of the container is also closed with a lid.

13. The packaging as claimed in claim 8, wherein the overhanging part of the foil layer pleated along the outer side of the container encloses an angle with the foil material closing the opening of between 45 and 135 degrees.

14. The packaging as claimed in claim 13, wherein the angle A is between 80-100 degrees.

15. The method as claimed in claim 1, wherein the container is one from the group of a tray, tub, bucket, cup, dish, and jar.

16. The method as claimed in claim 1, wherein the container is plastic.

17. The method as claimed in claim 8, wherein the conatiner is plastic.

* * * * *

UNITED STATES PATENT AND TRADEMARK OFFICE

CERTIFICATE OF CORRECTION

PATENT NO. : 9,085,400 B2
APPLICATION NO. : 13/001952
DATED : July 21, 2015
INVENTOR(S) : Wilhelmus Henricus Maria Van Cuijk It is certified that error appears in the above-identified patent and that said Letters Patent is hereby corrected as shown below:

In the Claims

Column 5, Line 19, Claim 4, delete "s" and insert -- is --

Column 6, Lines 30-31, Claim 17, delete "conatiner" and insert -- container --

Signed and Sealed this
Nineteenth Day of July, 2016

Michelle K. Lee

Michelle K. Lee
*Director of the United States Patent and Trademark Office*